US009865423B2

(12) United States Patent
Lemaitre et al.

(10) Patent No.: US 9,865,423 B2
(45) Date of Patent: Jan. 9, 2018

(54) X-RAY TUBE CATHODE WITH SHAPED EMITTER

(71) Applicant: General Electric Company, Schenectady, NY (US)

(72) Inventors: Sergio Lemaitre, Milwaukee, WI (US); Ben David Poquette, Milwaukee, WI (US); Ryan James Lemminger, Milwaukee, WI (US); Donald Robert Allen, Waukesha, WI (US); Judson Sloan Marte, Niskayna, NY (US); Gregory Alan Steinlage, Milwaukee, WI (US); Richard Michael Roffers, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 240 days.

(21) Appl. No.: 14/446,699

(22) Filed: Jul. 30, 2014

(65) Prior Publication Data

US 2016/0035532 A1 Feb. 4, 2016

(51) Int. Cl.
*H01J 35/00* (2006.01)
*H01J 35/06* (2006.01)

(52) U.S. Cl.
CPC ..... *H01J 35/06* (2013.01)

(58) Field of Classification Search
CPC ..... H01J 35/06
See application file for complete search history.

(56) References Cited

U.S. PATENT DOCUMENTS

| | | | | |
|---|---|---|---|---|
| 3,882,339 | A | 5/1975 | Rate, Jr. et al. | |
| 5,907,595 | A * | 5/1999 | Sommerer | H01J 35/06 378/119 |
| 6,556,656 | B2 | 4/2003 | Hess et al. | |
| 7,062,017 | B1 | 6/2006 | Runnoe | |
| 2004/0146143 | A1 | 7/2004 | Price et al. | |
| 2008/0267354 | A1 * | 10/2008 | Holm | H01J 33/00 378/122 |
| 2011/0169405 | A1 * | 7/2011 | Baik | H01J 25/34 315/5.39 |
| 2013/0162134 | A1 * | 6/2013 | Mattausch | H01J 3/025 313/33 |

* cited by examiner

*Primary Examiner* — Dani Fox
(74) *Attorney, Agent, or Firm* — Boyle Fredrickson, S.C.

(57) ABSTRACT

An emitter for a cathode of an X-ray tube is provided that includes a shaped emitting surface. The emitting surface is shaped in a suitable process in order to enable the emitting surface to focus electron beams emitted from the emitting surface on a focal spot on a target of less than 1.0 mm without the need for any additional focusing elements in the X-ray tube.

17 Claims, 5 Drawing Sheets

X-RAY TUBE CATHODE WITH SHAPED EMITTER

BACKGROUND OF THE INVENTION

The invention relates generally to X-ray tubes, and more particularly to cathodes for use within X-ray tubes.

An X-ray tube is, generally, used for a system which sees through the inside of human bodies or other objects of interest, such as a medical or an industrial diagnosis system. The X-ray tube is formed with a cathode, an anode and/or target and a vacuum enclosure which houses the cathode and the anode/target therein. By applying a high voltage between the cathode and the anode target, electrons emitted from the cathode side impinge on the anode target and thereby X-rays emanate from the anode/target which are then directed at the object of interest to produce the X-ray image of the object.

Certain X-ray tube architectures require long electron beam paths in an electrical field free region. In these prior art X-ray tubes 10 shown in FIG. 1, the cathode 12 is formed with an emitter 13 having a flat emitting surface 14 in a vacuum enclosure 11. When the emitter 13 in the cathode 12 is energized, the flat surface 14 is able to direct the beams of electrons 16 from the cathode 12 in a specified direction through a drift tube 17 towards the anode or target 18, i.e., in a straight line from the flat surface 14 towards the target 18. When the beams 16 strike the target 18, the target 18 emits X-rays in a specified direction toward the object to be imaged.

In situations where it is desired to increase the resolution and/or reduce the size of the location onto which the X-rays are to be directed, it is necessary to focus the beams 16 from the emitted from the flat surface 14 of the emitter 13 in the cathode 12 more closely onto the target 18 to the focal spot corresponding to the desired area of the object, as these beams 16 are directed perpendicularly from the surface 14 of the emitter 13. This is especially true in situations where the architecture of the X-ray tube 10 requires a long electron beam path between the cathode 12 and the target 18. To do so, prior art X-ray tubes 10 use a number of different structures and methods, including electromagnetic and electrostatic focusing, among other conventional methods. In one conventional prior art structure and method, the X-ray tube 10 includes a number of focusing elements 20 located between the emitter 13 and the anode or target 18. In operation, the focusing elements 20, such as quadrupole magnets, for example, are operated to effect the change the strength of an electric field in the drift tube 17. The resulting changes in the electric field strength alters the path of the electron beams 16 as they pass through the drift tube 17, enabling the beams 16 to be focused on a more narrow area or focal point 22 on the target 18.

However, the use of the focusing elements 20 to enable focusing of the electron beams 16 from the flat emitting surface 14 of the cathode 12 adds significant complexity and cost to the tube 10. Further, as shown in FIG. 2, these prior art X-ray tubes 10 employing flat emitters 13 in the cathodes 12 have inherent aberrations in the beams 16 emitted therefrom and cannot be focused with a resolution of less than 1.0 mm. Therefore, it is desirable to provide an improved X-ray tube structure and method of manufacturing the tube structure and the emitter to enable focusing of the electron beam without the need for additional electrical and/or magnetic focusing elements.

BRIEF DESCRIPTION OF THE INVENTION

In the present invention an X-ray tube is provided that is formed with a cathode having an emitter with a shaped emitting surface. The shape of the emitting surface is formed as desired in a suitable process to enable the emitter to direct the electron beams emitted from the emitting surface toward the intended and narrower focal spot on the target, such that additional focusing elements, structures and/or methods are minimized or not required for the X-ray tube.

DETAILED DESCRIPTION OF THE INVENTION

Figure 3:
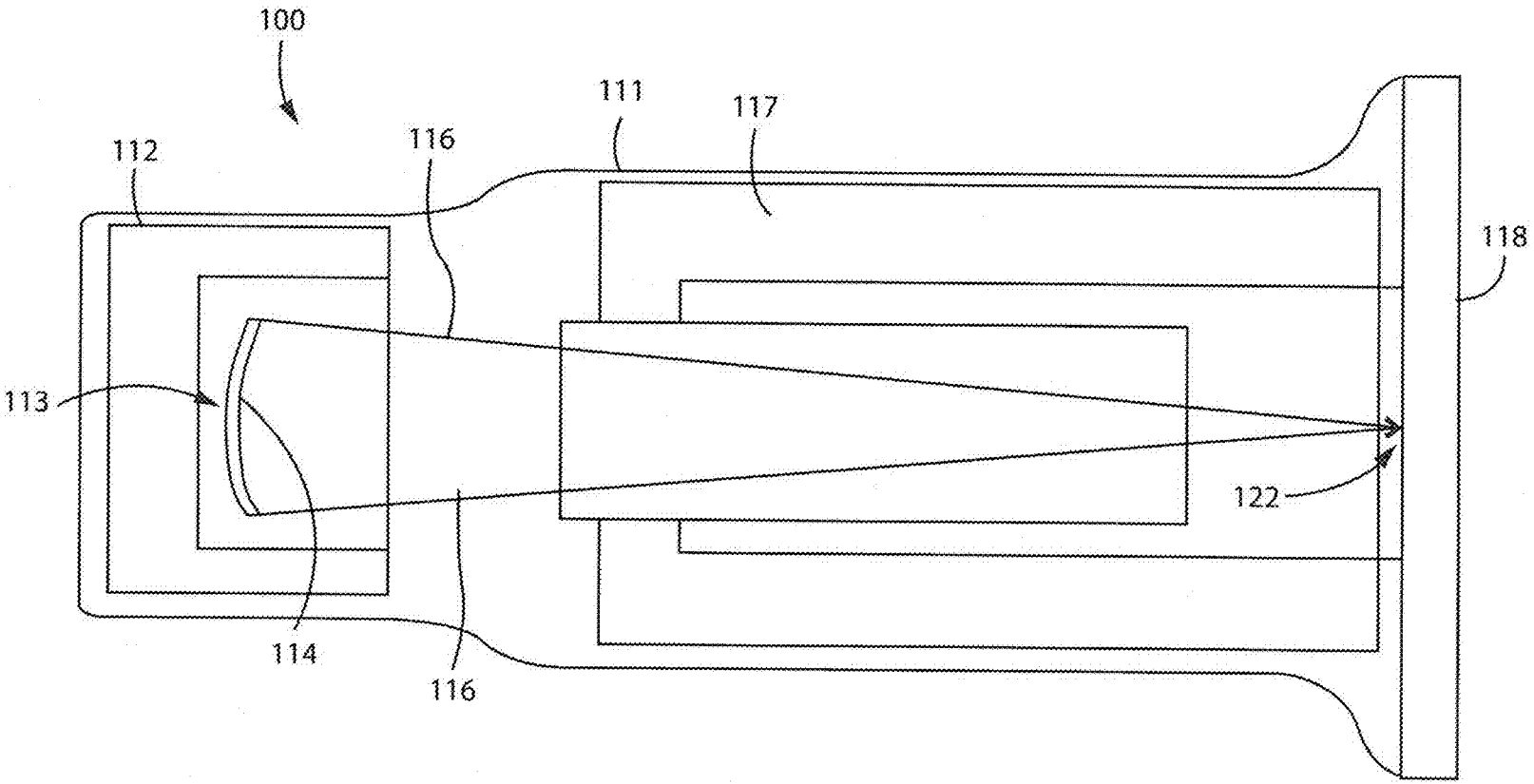
FIG. 3 is a schematic view of an X-ray tube in accordance with an exemplary embodiment of the invention

FIG. 3 illustrates a schematic view of an X-ray tube 100 in accordance with an exemplary embodiment of the present invention. X-ray tube 100 includes an enclosure 111 within which a vacuum is formed, and which houses a cathode 112 at one end, an anode or target 118 generally opposite the cathode 112, where the anode or target 118 is formed of any suitable material capable of producing X-rays when contacted with electrons/electron beams 116 emitted from the cathode 112, and a drift tube 117 located between the cathode 112 and the target 118. However, the X-ray tube 100 may be formed in a variety of shapes and sizes, and with configurations varying from that in FIG. 3, such as by separating the anode and target into different elements, incorporating additional elements or structures, or removing structures shown, and still lie within the scope of this invention.

FIG. 3 illustrates an exemplary embodiment of the X-ray tube 100 in which the cathode 112 includes a housing 121 formed of a suitable material in which is disposed an emitter 113 formed of any suitable emissive material. In this exemplary embodiment the emitter 113 includes a curved or concave emitting surface 114 on one side of the emitter 113 that operates to direct beams of electrons 116 emitted from the emitting surface 114 in a specified direction towards a focal point 122 on the target 118. As the electron beams 116 are discharged from the emitter 113 in a direction perpendicular to the emitting surface 114, the shape of the emitting surface 114 directs the beams 116 inwardly towards the focal point 122, without any other focusing elements in the X-ray tube 100 outside of the emitting surface 114 on the emitter 113 within the cathode 112. The cathode 112, emitter 113 and target 118 are operably connected to a suitable power source to energize the emitter 113 and cause the discharge of electron beams 116 from the emitting surface 114 of the emitter 113 towards the target 118. Any suitable power source (not shown) and/or manner of energizing the emitter 113 is contemplated, such as indirectly heated emitters, but in the exemplary embodiment of FIG. 3, the emitter 113 is directly or resistively heated using the power source in order to emit the electron beams 116 from the emitting surface 114 to strike the target 118 and produce X-rays.

Figure 1:
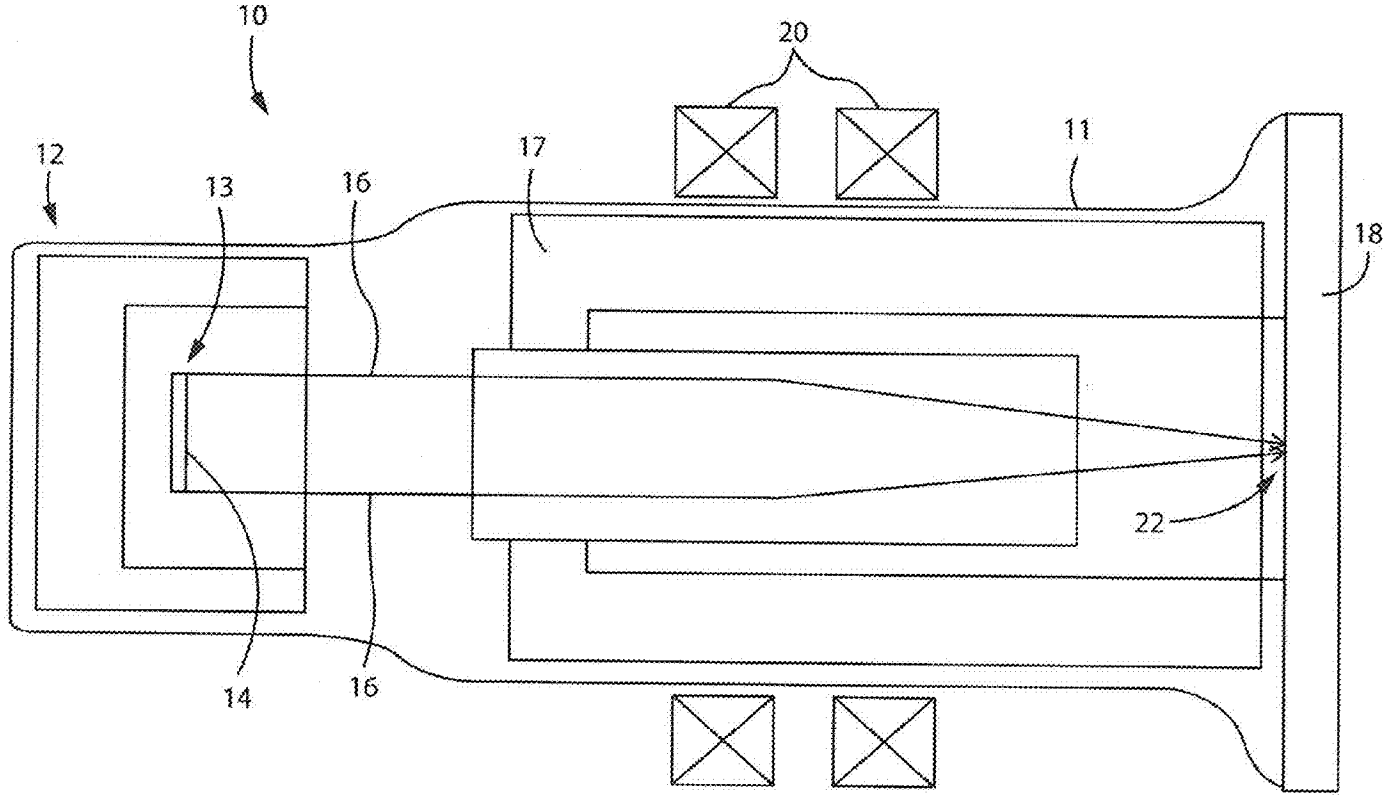
FIG. 1 PRIOR ART
FIG. 1 is a schematic view of a prior art X-ray tube including an electromagnetic focusing structure.
Figure 2:
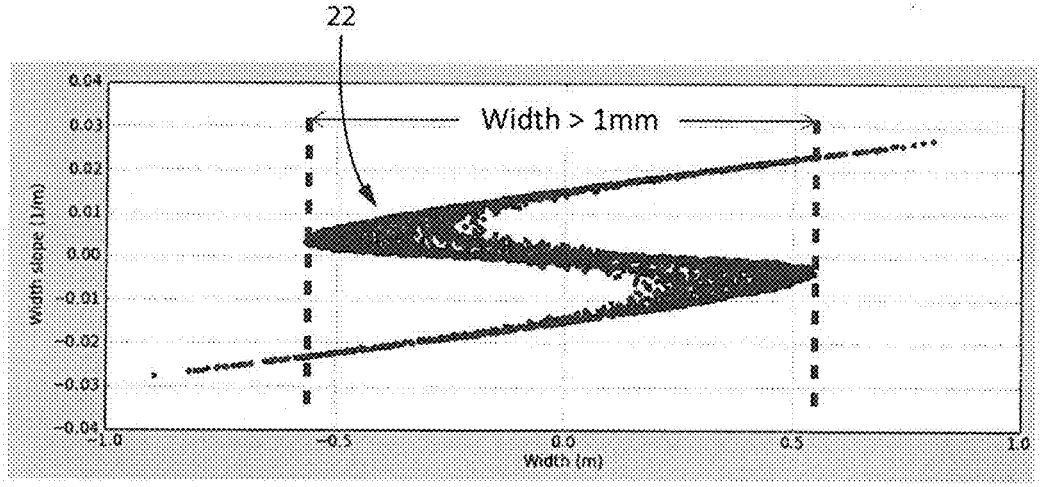
FIG. 2 PRIOR ART
FIG. 2 is a graph of a beam phase space plot at a focal spot using the X-ray tube of FIG. 1.
Figure 6:
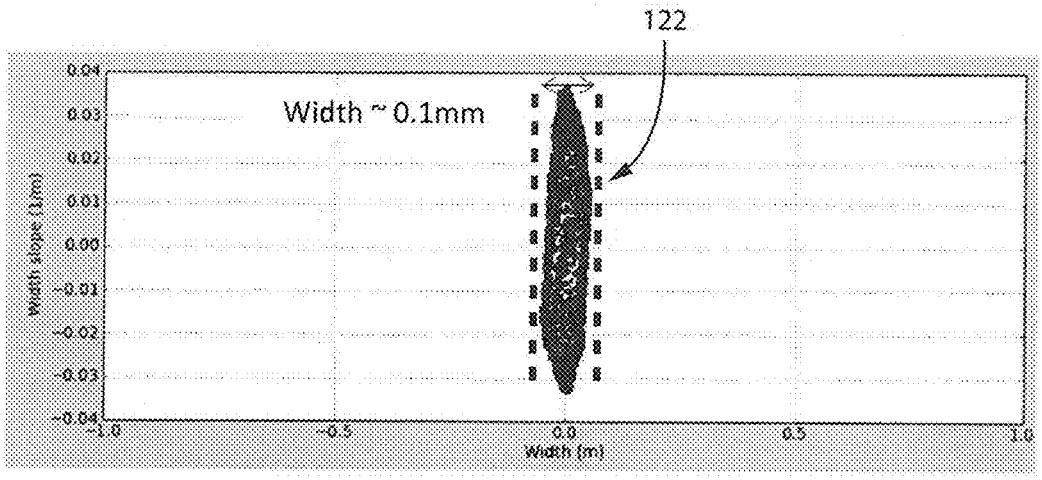
FIG. 6 is a graph of a beam phase space plot at a focal spot using the X-ray tube of FIG. 3.
Figure 4:
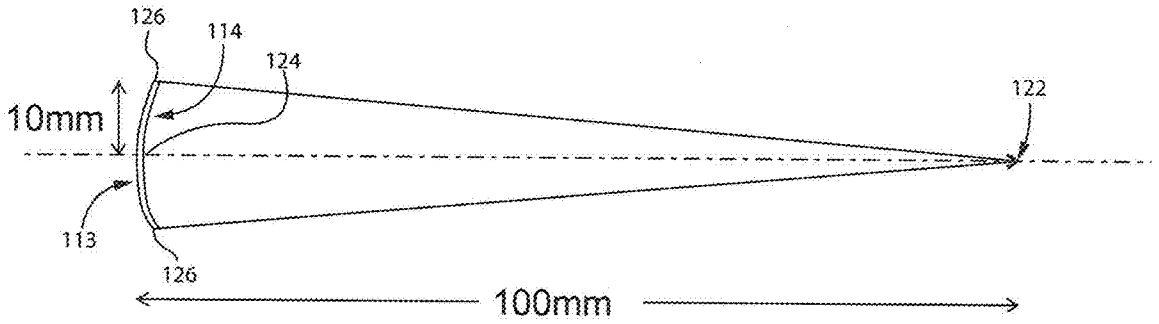
FIG. 4 is a schematic view of the operation of a shaped emitter utilized in the X-ray tube in accordance with an exemplary embodiment of the invention.

In the exemplary embodiment of FIG. 4, the emitting surface 114 is shaped to have a height difference from the center 124 of the emitting surface 114 to each end 126 of the emitting surface 114 sufficient to direct the electron beams 116 onto the desired focal point 122. While the shape of the emitting surface 114 can be selected as desired to direct the beams 116 onto the predetermined focal point 122, in the in the exemplary illustrated embodiment of FIG. 4 the emitting surface 114 has a curvature or height difference of 1.0 mm on a emitting surface 114 with a radius of 10 mm. In general, in an exemplary embodiment, the surface geometry of the emitter 113 can be selected to define angles from the center 124 and either end 126 of the emitting surface 114 of between about 2° to about 15°, with another exemplary embodiment defining a range of between about 4° to about 10°, and still a further exemplary embodiment defining an angle of about 6°. Further, in the exemplary embodiment of FIG. 4, the ratio of the radius of the emitter 113 and the length between the center 124 of the emitting surface 114 and the focal point 122 on the target 118 to 1/10, though other ratios can additionally be employed, such as ratios of between 1/6 and 1/13. In this configuration, the X-ray tube 100 can emit an electron beam 116 onto a focal spot or point 122 that is less than 1.0 mm in width, and optionally less than 0.3 mm in width and even less than 0.1 mm in width, as shown in FIG. 6.

Figure 5:
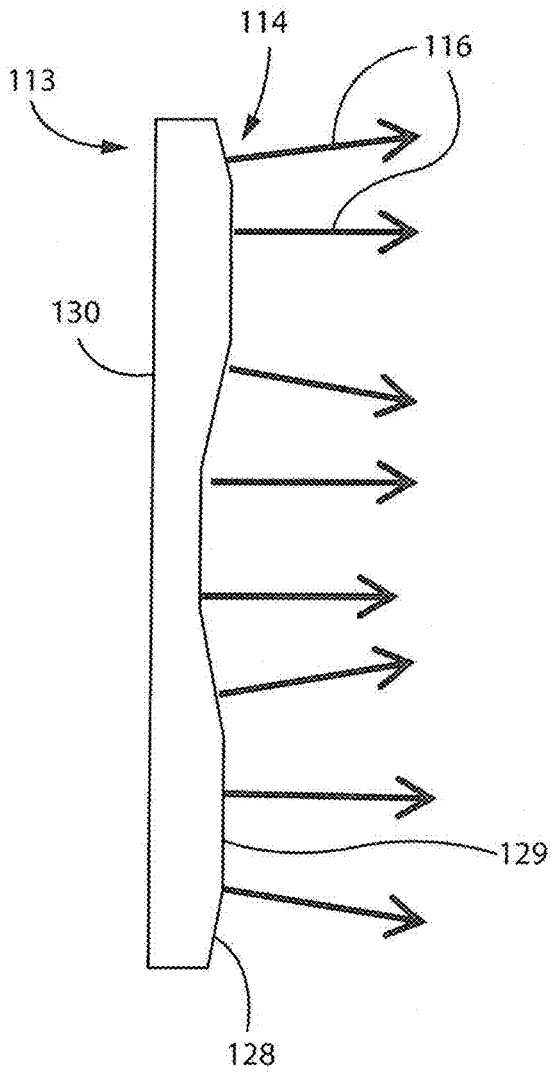
FIG. 5 is a schematic view of a shaped emitter utilized in an X-ray tube in accordance with an exemplary embodiment of the invention.

In addition, while the exemplary embodiments of FIGS. 3 and 4 show a concave curvature across the entire emitting surface 114 from the center 124 to each end 126, the emitting surface 114 can be formed or shaped with other configurations, such as a flat central portion (not shown) surrounded by a curved portion (not shown) extending between the flat central portion and the ends 126, or as shown in the exemplary embodiment of FIG. 5, a number of distinct shaped sections 128 disposed adjacent or separated from one another by a number of flat sections 129 along the emitting surface 114. These distinct shaped sections 128 can be formed in any desired configuration, e.g., slanted, angular or curved with similar or with different radii of curvature in order to reduce and/or remove any aberrations from the electron beams 116 emitted from the emitting surface 114 of the emitter 113. Further, the emitter 113 can be formed to impart a desired shape or configuration to the rear surface 130 of the emitter 113 in addition to the emitting surface 114 to accommodate thermal performance needs for the emitter 113, such as but not limited to, a required heating current cross section.

Also, in other exemplary embodiments, the emitting surface 114 can be formed as a concave surface with a profile of a portion of a sphere with the same radius of curvature along the length and width of the emitting surface 114, such that all of the beams 116 are emitted from the emitting surface 114 to a single focal point 122, or the emitting surface 114 can be formed as a concave surface with a profile of a portion of a cylinder (not shown) with the same radius of curvature along only the width of the emitting surface 114 such that the beams 116 are emitted onto a focal line (not shown), among other suitable configurations.

In forming the emitter 113 with the shaped emitting surface 114, in an exemplary embodiment it is desirable to have a form tolerance on the emitting surface 114 of less than 200 μm to ensure optics capability, and a cross sectional area tolerance across the emitter 113 of less than 10% to avoid hot spots.

With these tolerances for the emitter 113, it is desirable to form the emitter 113 with the emitting surface 114 in a manner and/or with certain features that enables the emitter 113 and emitting surface 114 to retain or preserve the desired shape after formation to function as intended.

Methods and processes that meet these criteria for the methods and processes suitable for the formation of the emitter 113 from a suitable emissive material include but are not limited to:

a. Additive methods and processes for forming the emitter 113 of a suitable emissive material include but are not limited to printing methods including both wire and powder based methods using a variety of energy sources (laser, e-beam, green body+sinter, etc.), conventional spark plasma sintering processes (SPS), powder-based SPS, and SPS utilizing a stylus to increase power density and to improve sintering via the stylus;

b. Material removal methods and processes for forming the emitter 113 of a suitable emissive material include but are not limited to grinding, electrodischarge machining (EDM) in wire and ram configurations, plunge EDM, electrochemical machining (ECM), photolithography masking followed by chemical or electrochemical machining, laser machining or electron beam machining and waterjet machining; and c. Forming methods and processes for forming the emitter 113 of a suitable emissive material include but are not limited to using temperature gradients on the emissive material e.g. using laser, electron beam, or electric are to cause bending of the emissive material with no die contacting the material being formed.

These methods and processes can optionally be combined with one another, and optionally combined with other forming methods or processes including dies, such as hot forming, to form the emitter, as well as optionally being coupled with advanced metrology feedback methods for even better control of the shaping of the emitter 113 and the emitting surface 114.

Among other suitable processing methods and steps capable of producing this result, in an exemplary embodiment the processing steps and methods used to form the emitter 113 with the emitting surface 114 are methods and processes that are non-contact methods and processes, i.e., methods and processes that do not involve any direct tool to emitter contact during the formation of the emitter 113 and emitting surface 114. In one particular exemplary embodiment, electrochemical machining (ECM) is utilized to precisely tailor the desired geometry for the emitter 113 and the emitting surface 114. ECM can be loosely compared to a stamping process in that a tool, which is the electrode in ECM, having a negative of the intended geometry is used to chemically imprint fine surface features onto the part, i.e. the emitter 113 and emitting surface 114. This non-contact process avoids tool wear leading to extremely high repeatability and does not introduce residual or surface stresses in the emitter 113 or emitting surface 114. This method also provides submicron precision which is not subject to shift due to tool wear, which is not present. Further, the cycle times surrounding overall the ECM cutting process generally range from several seconds to several minutes, making the method suitable for production of the emitter 113 having the desired geometry for the emitting surface 114.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A cathode adapted for use with an X-ray tube, the cathode comprising:

a housing: and an emitter formed of an electron beam emissive material and disposed within the housing, the emitter including a rear surface and an emitting surface generally opposite the rear surface, the emitting surface having at least one shaped section, and wherein the at least one shaped section is at least one concave section, wherein the emitting surface comprises a number of separate shaped sections and wherein the emitting surface comprises at least one flat section.

2. The cathode of claim 1 wherein the at as one flat section is disposed between adjacent shaped sections.

3. The cathode of claim 1 wherein the rear surface includes at least one shaped section.

4. The cathode of claim 1 wherein the emitting surface focuses emitted electron beams on a focal spot of less than 1.0mm in width.

5. The cathode of claim 1 wherein the emitter is formed in a method or process selected from the group consisting of: additive methods and processes, material removal methods and processes, forming methods and processes using temperature gradients to cause material bending with no die contacting the material being formed, and combinations thereof.

6. The cathode of claim 5 wherein the additive methods and processes are selected from the group consisting of printing methods including both wire and powder based methods, spark plasma sintering processes (SPS), powder-based SPS, and SPS utilizing a stylus.

7. The cathode of claim 5 wherein the material removal methods and processes are selected from the group consisting of grinding, electrodischarge machining (EDM) in wire and ram configurations, plunge EDM, electrochemical machining (ECM), photolithography masking followed by chemical or electrochemical machining, laser machining or electron beam machining and wateijet machining.

8. The cathode of claim 5 wherein the forming methods and processes are selected from the group consisting of laser methods, electron beam methods, and electric arc methods.

9. The cathode of claim 5 wherein the forming methods and processes further comprises a separate forming method or process that utilizes a die to contact the emitter.

10. The cathode of claim 1 wherein the at least one concave section defines an angle from a center of the at least one concave section to one end of the at least one concave section of between about 2° to about 15°.

11. The cathode of claim 1 wherein the emitter has a ratio of a radius of the emitter and a length between a center of the at least one concave section and a focal point between 1:6 and 1:13.

12. The cathode of claim 11 wherein the focal point is less than 1.0mm in width.

13. The cathode of claim 1 wherein the emitting surface include at least one flat section adjacent the at least one concave section.

14. The cathode of claim 13 wherein the at least one concave section and the at least one flat section are formed as a unitary emitting surface.

15. The cathode of claim 1 wherein the at least one concave section has a profile of a portion of a sphere.

16. The cathode of claim 1 wherein the at least one concave section has a profile of a portion of a cylinder.

17. The cathode of claim 1 wherein the emitter is formed in a process that does not utilize a die.

* * * * *